United States Patent [19]

Schenk

[11] 3,944,371

[45] Mar. 16, 1976

[54] RETRACTABLE WRITING IMPLEMENT

[75] Inventor: Richard Schenk, White Plains, N.Y.

[73] Assignee: Stacie Pen Corporation, Brooklyn, N.Y.

[22] Filed: Apr. 16, 1975

[21] Appl. No.: 568,401

[52] U.S. Cl. ..... 401/110
[51] Int. Cl.[2] ..... B43K 24/06
[58] Field of Search ..... 401/109–111, 401/116, 62, 99

[56] References Cited

UNITED STATES PATENTS

| | | | |
|---|---|---|---|
| 2,865,331 | 12/1958 | Marcotte | 401/111 |
| 2,865,333 | 12/1958 | Hechtle | 401/111 |
| 3,315,643 | 4/1967 | Eratico | 401/109 |
| 3,679,318 | 7/1972 | Liguori | 401/110 |
| 3,792,931 | 2/1974 | Ganz | 401/109 |

FOREIGN PATENTS OR APPLICATIONS

| | | | |
|---|---|---|---|
| 934,160 | 8/1963 | United Kingdom | 401/111 |

*Primary Examiner*—Lawrence Charles
*Attorney, Agent, or Firm*—Larson, Taylor and Hinds

[57] ABSTRACT

A retractable ball-point pen includes a housing comprising a barrel and cap, the latter being rotatable with respect to the former to control extension and retraction of a writing tube located within the housing. A ferrule which is pressfit into an opening at the non-writing end of the barrel serves as a mount for a guide bushing having an offset bore therein through which a writing tube extends. The cap rotates about the cylindrical surface presented by the bushing and a retaining ring which engages the inner wall of the cap prevents axial movement of the cap. A cam member which includes a helical cam surface is fixedly mounted in the cap and a spring biases writing tube against the cam surface so that rotation of the cap in first direction causes extension of the tube while rotation in the opposite direction causes retraction of the tube.

1 Claim, 6 Drawing Figures

RETRACTABLE WRITING IMPLEMENT

FIELD OF THE INVENTION

The present invention relates to a mechanism for extending and retracting the writing end or point of the writing tube of a ball-point pen or like writing implement.

BACKGROUND OF THE INVENTION

Many conventional ball-point pens include an ink containing "writing tube" or refill which is normally retracted within the casing of the pen and which can be extended to expose the pen point when the pen is to be used. A number of different types of mechanisms are used for this purpose. Perhaps the most common of these includes a push-button located at the non-writing end of the pen which is depressed to cause an extending movement of the refill tube and a catch, which is released when the push-button is depressed, and cooperates with a spring to enable the refill tube to be retracted.

A retractable ball-point pen mechanism of particular interest here is that disclosed in U.S. Pat. No. 3,315,643 (Eratico). The mechanism in question includes a hollow tubular casing which is open at one end to permit the point of the refill tube to be extended therethrough and a impeller, including a helical cam surface, which is rotatably mounted within the casing and which engages the other end of the refill and, when rotated, causes axial movement of the refill tube. The casing includes a barrel portion and cap portion, the impeller being located within the cap portion. The refill tube is mounted within the casing with the aid of a bushing which is fixed within the cap portion, the refill extending through an axial aperture in the bushing which is offset with respect to the longitudinal axis of the bushing. The impeller is affixed to a small knob located at the non-writing end of the casing so that rotation of the knob causes rotation of the impeller and thereby produces axial movement of the refill tube. A spring biases the non-writing end of the refill tube against the cam surface of the impeller so that rotation of the control knob in a first direction causes the writing end of the refill tube to be extended beyond the end of the casing so that the pen can be used to write and rotation of the knob in the opposite direction causes the refill to be retracted within the casing.

Although the writing implement disclosed in the Eratico patent possesses significant advantages flowing from the simplicity of the retraction mechanism, the writing implement suffers at least one important disadvantage. Specifically, the provision of a small control knob at the end of the implement for controlling extension and retraction of the refill tube makes the implement unwieldy and relatively awkward to handle, particularly as compared with similar implements in which rotation of the cap portion provides the required extension and retraction movements.

A further patent of interest is Italian Pat. No. 518,042 which operates in a similar manner to the Eratico patent discussed above and does provide for extension and retraction of individual ones of three different writing tubes responsive to rotation of a cap. However, in the Italian Patent, the drive cam is located within a hollow housing about which the cap rotates and is attached to a screw element which rotates when the cap is rotated. The hollow housing screws into a support or guide bushing which is mounted in the non-writing end of the barrel of the pen. Thus elements of this arrangement are relatively difficult, and hence expensive, to manufacture and the arrangement is somewhat cumbersome particularly regarding replacement of the writing tubes.

Other patents which disclose extension and retraction mechanisms of interest include U.S. Pat. Nos. 2,865,331 (Marcotte); 3,679,318 (Liguori); and 3,792,931 (Ganz) although this listing is not intended to nor represented to be exhaustive.

SUMMARY OF THE INVENTION

Generally speaking, the invention concerns a writing implement which includes an extension and retraction mechanism that combines the relative simplicity of a writing implement such as that of the Eratico Patent discussed above with the ease of use provided by more complex and hence more expensive implements. More specifically, a writing implement is provided which includes simple parts that are relatively few in number and can be manufactured inexpensively, which is considerably more durable and rugged than push-button type pens and which provides extension and retraction of the writing tube or refill through simple rotation of the entire cap portion of the implement. This latter feature, which is characteristic of more expensive pens, is clearly advantageous when compared with a mechanism such as taught in the Eratico patent wherein it is necessary to rotate a relatively small knob located at the end of the pen to provide extension and retraction. Further, the operating components of the retraction mechanism of the invention, as well as the overall mechanism itself, are considerably simpler and hence less expensive to manufacture than those of Italian Pat. No. 518,042 discussed above and the writing implement of the invention is generally easier to use.

According to a preferred embodiment thereof, the invention includes a housing formed by a barrel portion which includes openings at both ends and a cap portion which is open at one end, the latter being rotatable with respect to the former. A ferrule, which pressfit inside the end of the barrel adjacent the cap, serves a mount for a guide bushing which extends beyond the end of the barrel and provides a surface about which the cap rotates. A retaining ring is mounted for rotation within a peripheral groove in the bushing and engages the inner surface of the cap so that the ring rotates with the cap. The retaining ring prevents axial movement of the cap while permitting free rotation of the cap about the surface of the bushing. A cam member is mounted within the cap which includes a helical cam surface for controlling extension and retraction of a writing tube. The latter extends through an axial bore in the guide bushing which is offset laterally from the longitudinal axis of the bushing. A spring biases the writing tube into engagement with the cam surface and when the cap is rotated in a first direction so that the helical cam surface advances axially, the end of the writing tube is extended through the opening of the end of the barrel against the biasing force of the spring. When the cap is rotated in the opposite direction the cam surface recedes axially and the end of the writing tube is retracted within the barrel.

Other features and advantages of the invention will be set forth in, or apparent from, the detailed description of a preferred embodiment found hereinbelow.

DESCRIPTION OF THE PREFERRED EMBODIMENTS

Figure 1:
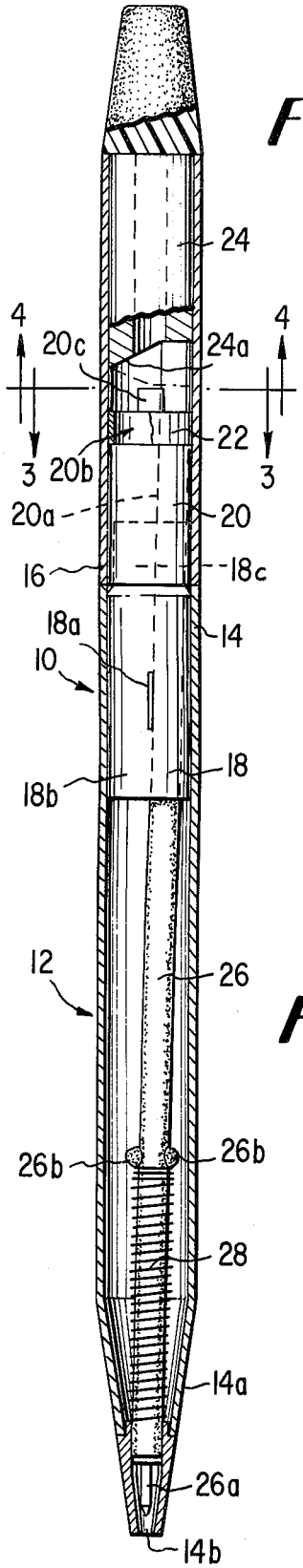
FIG. 1 is a side elevational view, partially in section, of a writing implement constructed in accordance with a preferred embodiment of the invention.

Referring to FIG. 1, a writing implement is shown which is generally denoted 10 and which, in the exemplary embodiment under consideration, constitutes a ball-point pen. Implement 10 comprises an elongate casing 12 made up of a hollow tubular barrel 14 and a hollow tubular cap 16, both having the same outside diameter. The lower or writing end of barrel 14 is tapered as indicated at 14*a* and terminates in an opening 14*b*.

The upper end of barrel 14 is open to permit receipt of a generally cylindrical ferrule 18 therein. The ferrule 18 is pressfit within the upper opening in barrel 14 and may include longitudinal splines 18*a* thereon for ensuring a tight fit between a hollow cylindrical bore 18*b* of the ferrule 18 and the inner wall of barrel 14 and to prevent relative rotation. However, the frictional forces between the base 18*b* and the inner wall of barrel 14 are such that ferrule 18 can be removed by simply pulling the ferrule 18 out of barrel 14.

Ferrule 18 serves to fixedly mount a guide bushing 20 thereon, bushing 20 being mounted on the upper end 18*c* of ferrule 18 and extending beyond the end of barrel 14 as shown. Bushing 20 includes a cylindrical outer surface 14*a* about which the cap 16 rotates. Bushing 20 includes longitudinal bore 20*a* which is offset from the longitudinal axis thereof. An annular groove 20*b* is located at the free end of bushing 20 and receives a retaining ring 22 therein. Bushing 20 includes a diametric stop portion 20*c* which extends outwardly from the free end thereof. As can best be seen in FIG. 3, although stop portion 20*c* is of reduced cross-section as compared with the remainder of the bushing 20 the outside diameter of stop portion 20 is greater than that of groove 20*b* so that stop portion 20*c* retains ring 22 in position on bushing 20. The outside diameter of ring 22 is such that ring 22 is snugly received within cap 16, while the inside diameter of ring 22 is such that ring 22 is free to rotate about the surface defining groove 20*b*. Thus, retaining ring 22 permits rotation of cap 16 about bushing 20 while preventing axial movement of cap 16 and thereby preventing cap 16 from falling off.

Figure 2:
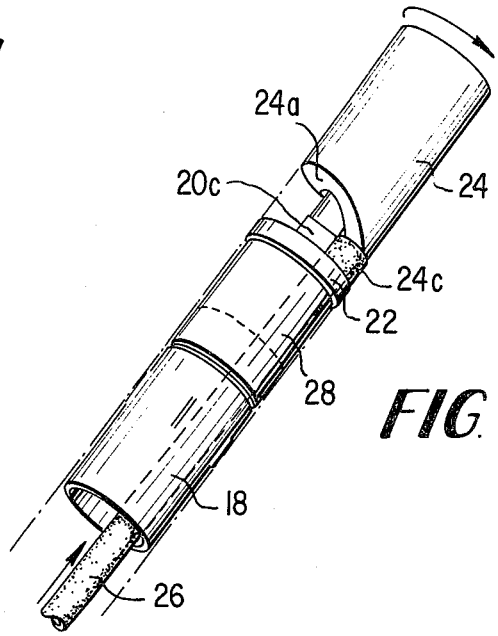
FIG. 2 is a perspective view of the principal operating elements of the writing implement of FIG. 1.
Figure 3:
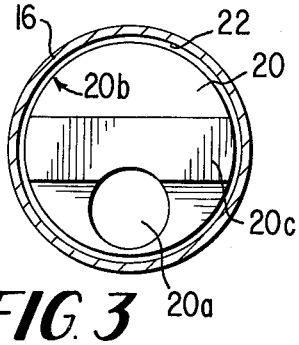
FIG. 3 is a sectional view, to an enlarged scale, taken generally along line 3—3 of FIG. 1.
Figure 4:
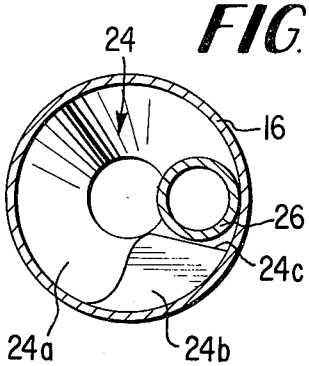
FIG. 4 is a section view, to an enlarged scale, taken generally along line 4—4 of FIG. 1 illustrating a first rotational position of the cam.
Figure 5:
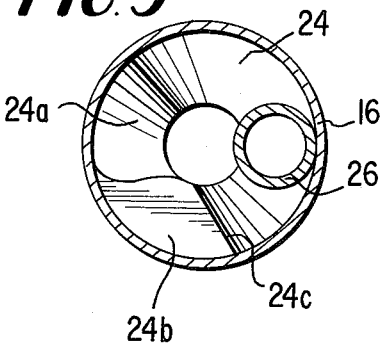
FIGS. 5 and 6 are enlarged sectional views taken along line 4—4 of FIG. 1 showing further rotational positions of the cam.
Figure 6:
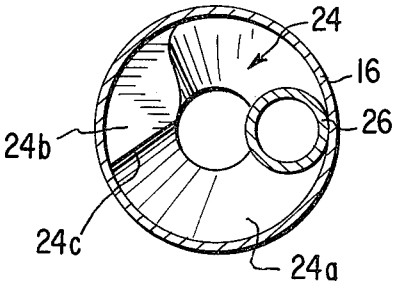

A cam member 24 which is fixedly mounted within cap 16 includes a drum-type cam surface 24*a* of generally helical configuration as can perhaps best be seen in FIG. 2 and in FIGS. 3 to 5. The cam member 24 also includes a stop portion 24*b* including a stop surface or plane 24*c* which is parallel to the longitudinal axis of casing 11 and limits rotation of cam member 24.

A conventional writing tube or refill 26 is mounted within casing 12 and extends along the length thereof through the opening in ferrule 18 and the offset bore 20*a* in guide bushing 20. Writing tube 26 includes a writing point 26*a* which is adapted to extend through the opening 14*b* in barrel 14. A spring 28, which engages and bears against a pair of conventional protuberances or ears 26*b* formed on tube 26, biases tube 26 against the face of cam surface 24*a*.

The operation of the writing implement of the invention should be apparent from the foregoing. Since the radial position of the non-writing end of writing tube 26 is fixed, rotation of cap 16 will cause different portions of the cam surface 24*a* to be brought into contact with this end of tube 26. Thus, to cause axial movement of the writing tube 26 so as to extend the writing point 26*a*, cap 16 is rotated in a direction so as to bring the raised or upper portion of cam surface 24*a* into engagement with the end of the writing tube 26. In this position, the side of writing tube 26 will engage cam stop surface 26*c*, as shown in FIG. 4, so that the latter determines the limit position for rotation of cap 16. In this position, writing point 26*a* is extended through opening 14*b* beyond the end portion 14*a* of barrel 14. To retract the writing point 26*a*, cap 16 is simply rotated in the opposite direction so that tube 26 engages a lower portion of cam surface 24*a* and the biasing force of spring 28 will cause movement of tube 26 back to the retracted position thereof.

To replace writing tube 26 with a refill, one simply removes ferrule 18 from the end of barrel 14, inserts a refill through bore 20*a* and replaces ferrule 18.

While the invention has been described in detail with particular reference to the preferred embodiments thereof, it will be understood by those skilled in the art that variations and modifications can be effected in the exemplary embodiments within the spirit and scope of the invention.

I claim:

1. A writing implement comprising a. an elongate barrel having first and second openings at the opposite ends thereof, b. an elongate cap which includes an opening at one end thereof and which is rotatable with respect to said barrel, c. a ferrule which is removably received within said second opening of said barrel and which is in non-rotational frictional engagement with the inner sidewall surfaces of said barrel, d. a guide bushing which is non-rotatably affixed to said ferrule and which is received in said opening in said cap and about which said cap rotates, said guide bushing including an axially extending bore therein which is offset with respect to the longitudinal axis of said bushing, e. a retaining ring which is mounted for rotation on said guide bushing and which engages the inner surface of said cap so that said ring rotates with said cap, f. an elongate replaceable writing tube which extends through said bore in said bushing and which is adapted to move axially within said barrel, said writing tube including writing means at one end thereof, g. a cam member located within and affixed to said cap and including a helical cam surface which engages the other end of said writing tube, h. spring means for biasing said writing tube into engagement with said cam surface, so that, upon rotation of said cap in first direction, said cam surface causes the writing means of said writing tube to extend through said first opening in said barrel outwardly thereof and, upon rotation said cap in the opposite direction, said cam surface permits said writing means of said writing tube to be retracted within said barrel responsive to the urging of said spring means, said guide bushing being generally cylindrical in construction and extending beyond the end of the barrel to provide a surface about which said cap rotates, said bushing including a peripheral groove in which said retaining ring is received.

* * * * *